United States Patent [19]

Jaton

[11] Patent Number: 5,019,026

[45] Date of Patent: May 28, 1991

[54] DEVICE FOR ALIGNING BOX BLANKS WITHIN A MACHINE USED FOR PROCESSING THEM

[75] Inventor: Jean-Philippe Jaton, Val D'Illiez, Switzerland

[73] Assignee: Bobst SA, Switzerland

[21] Appl. No.: 476,614

[22] Filed: Feb. 7, 1990

[30] Foreign Application Priority Data

Feb. 9, 1989 [CH] Switzerland ..... 00453/89

[51] Int. Cl.[5] ..... B31B 3/04; B31B 5/62; B31B 1/64

[52] U.S. Cl. ..... 493/147; 493/125; 493/127; 493/179; 493/182

[58] Field of Search ..... 493/125, 126, 127, 142, 493/144, 147, 178, 179, 180, 181, 182

[56] References Cited

U.S. PATENT DOCUMENTS

| | | | |
|---|---|---|---|
| 1,298,586 | 3/1919 | Sidebotham | 493/179 |
| 1,346,899 | 7/1920 | LaBombard | 493/179 |
| 1,444,348 | 2/1923 | LaBombard et al. | 493/179 |
| 1,506,844 | 9/1924 | LaBombard et al. | 493/179 |
| 2,584,855 | 2/1952 | Feronani | 493/182 |
| 2,589,944 | 3/1952 | LaBombard | 493/179 |
| 3,605,576 | 9/1971 | Shields | 493/144 |
| 4,696,392 | 9/1987 | Chisholm | 493/144 |
| 4,708,708 | 11/1987 | Fries | 493/144 |

*Primary Examiner*—William E. Terrell

*Attorney, Agent, or Firm*—Hill, Van Santen, Steadman & Simpson

[57] ABSTRACT

An aligning device including an upward straightening appliance consisting of a row of levers equipped with rollers, said levers being mounted for pivoting around a horizontal axis relative to a base member, said base member being mounted for pivotable movement around a vertical axis on a longitudinally extending member, each of the base members being connected by a flexible member to a corner piece shiftable relative to the longitudinally extending member to cause pivoting of all of the base members around their vertical axes, a lower straightening appliance consisting of a driven endless belt supported on rollers arranged vertically aligned to the axes of the upper rollers, an arrangement for biasing the upper rollers against a blank carried on said belt and a lengthwise aligning rail adjustably positioned relative to the upper and lower straightening appliances.

6 Claims, 6 Drawing Sheets

DEVICE FOR ALIGNING BOX BLANKS WITHIN A MACHINE USED FOR PROCESSING THEM

BACKGROUND OF THE INVENTION

The present invention is directed to a device for aligning box blanks within a machine used for processing them, particularly for aligning blanks as they are being inserted into a folder-gluer.

Known folder-gluers are machines into which box blanks are fed one by one from underneath a pile in order to be carried into the various machine sections by means of conveyor belts for processing and to provide a "folded flat" and glued box blank at the end of the process in a terminal station. It is understood that the box blank undergoes several successive operations during its travel through the machine. Sequentially, the operations are effected as follows:

- Pre-breaking of the first and third blank folds in the first section of the machine with a re-opening so as to transfer the blank in a flat condition into the second section;
- Applying glue in the station designed for this purpose and from where the blank is then carried to a third section;
- Folding the blank lengthwise on its second and fourth folds in the station designed for this purpose;
- Subsequently conveying the blank into a fifth section, wherein pressing and stripping occurs and discharging the folded and glued blank into a pile in a sixth section which is the discharge or delivery section for the folded and glued blank.

In order to obtain accurate folding along all folding lines, the box blanks must be carried through the machine without any hazard of sidewise or lengthwise skidding or sliding. To this aim, the machines are equipped with a combination of upper and lower conveyor belts, as well as, in certain cases, a combination of one or several lower belt conveyors with upper pressure roller tracks.

One of the major difficulties in folder-gluers is the lack of functional precision of the device occurring with the infeed devices for infeeding the blanks into the folder-gluer. These infeed devices generally consist of a lower conveyor with multiple belts operating, on the one hand, jointly with a front gauge and leaving between the gauge and conveyor belts just sufficient space for letting through one blank each time and, on the other hand, with a slide guide adjustable to the size of the blank to be fed in. The sequential infeed of the blanks can be achieved by means of an appliance acting in such a way as to partially and temporarily block or obstruct the space existing between the conveyor belts and the lower end of the front gauge to thereby prevent the departure of the lowermost blank from the blank pile situated in the infeed device. The force for moving each of the blanks out of the infeed device is explainable by the fact that the adherence or friction between the lower blank side and the conveyor belts is much higher and stronger than the rubbing or friction on the upper surface between the blanks of the pile.

However, on account of this very adherence and/or friction enhance rubbing, it might happen, in certain cases, that the blank does not benefit from an even driving force along its entire length. This uneven driving force can be caused by dirty belts so that the blanks are fed into the machine obliquely, thus, rendering subsequent folding along the desired folding lines of the blank very difficult.

Devices for the correcting of the inaccurate alignment of blanks have been devised and are, preferably, arranged in a section situated immediately after the infeed device. Attempts have been made to use them as a substitute for the first fold pre-breaking section. An alignment correction device well known in the trade consists of a straightener consisting of a row of staggered lower and upper rollers arranged on lower and upper beams which allow the distance from one another to be adjusted to the thickness of the blanks travelling therebetween. The device allowing the beams to be spaced one from the other includes, moreover, a device insuring permanent and variable pressure of the upper rollers onto the upper blank surface. Both the upper and lower beams are, moreover, to be conceived in such a way as to be arranged with the required and fixed angle with regard to the longitudinal axis of the machine.

The assembly thus conceived acts jointly with a lengthwise guiding rail. Hence, with the correct inclination imparted to the straightener, the action of the rollers of the straightener on one or the other surfaces of the blank will apply or urge the edge of the blank against the lengthwise guiding rail and insure the straightening of all blanks during the course of travel through the device. As a result of this straightening of the blanks, all blanks will be positioned so that their respective folding line will be perfectly parallel to the machine's longitudinal axis.

The rollers fitted on both the upper and lower beams are driven by a flat belt imparting its motion to the rollers by means of a pulley mounted on the axle of every roller of the upper and lower beams. The staggered arrangement of rollers, thus, allows vertical shifting of the upper beam so as to cope with the changes in the thickness of the blanks being processed without thereby squeezing the driving belts between the two pulleys, which would occur without the staggered arrangement.

The solution consisting in fitting the rollers of a straightener on upper and lower beams slanted with regard to the longitudinal machine axis involves the necessity to adjust the clearance of about 2 mm between the blank edge and the lengthwise guiding rail at an inlet of the straightening device so that at the outlet of the straightening device, the blank edge will be pressed against the lengthwise rail so that the folding lines and successive blanks will always be in the same position with regard to the downstream folding appliances. The result will be a kind of funnel effect which, in certain cases, presses the blank edges violently against the lengthwise guiding rail and, thereby, causes it to be damaged. On the other hand, the clearance set at the inlet of the straightening device between the blank edge and the lengthwise guiding rail requires accurate crosswise setting of the straightener with regard to the infeed of the device and, since this clearance may be variable, depending on the features of the blanks to be processed, the operator is to proceed manually to this setting excluding, thereby, any automatic lateral setting of the various machine appliances.

Another shortcoming of this type of straightener lies in the fact that the force exerted on the blank by the upper rollers is directed between the lower rollers, which are not vertically aligned with the upper roller, and may result in forming undulations in the blank in the event of excessive pressure necessitated by a very smooth and skidding blank, for instance blanks with the print on one side and watertight coatings on the other. These undulations of the blank, though slight, are sufficient for preventing straightening of the blank or else they will at least by likely to disturb the operation of the straightener. Moreover, this kind of straightener is to be withdrawn from the machine in the event of a processing of box blanks not allowing its use. This will result in a considerable loss of time for dismantling the machine and converting the section of the folder-gluer mentioned hereinabove.

SUMMARY OF THE INVENTION

The purpose of the present invention consists in providing a box blank aligning device which will overcome the above-mentioned shortcomings, improve the time to be used for setting-up the successive appliances of the folder-gluer and enable its optimal automation.

To accomplish these goals, the present invention is directed to an improvement in a device for aligning box blanks within a machine processing the blanks, especially for a folder-gluer, said device comprising upper straightening means, lower straightening means, said upper and lower straightening means acting jointly with a lengthwise aligning means, said upper straightening means being provided with means for adjusting pressure of the upper straightening means on the box blanks. The improvements are that the upper straightening means comprises a fixed lengthwise beam being permanently fitted on a frame of the machine, a plurality of roller assemblies being mounted in spaced relationship along the length of the lengthwise beam, each assembly including a base, means mounting the base on the beam for pivotable movement on a vertical axis, a lever having a roller mounted for rotation on one end and being connected to said base for pivoting around a horizontal axle, each of said horizontal axles having a flexible member disposed at one end, said flexible members being permanently connected to a corner piece mounted on said lengthwise beam for adjustable movement in a horizontal plane relative to said beam, the lower straightening means consisting of an endless belt driven and supported by a plurality of rollers with the rollers having their axles being aligned vertically relative to the axles of the rollers of the upper straightening means, said lengthwise aligning means comprising a lengthwise guiding rail being mounted for shifting in a horizontal plane with regard to the straightening means, and the means for adjusting the pressure of the upper straightening means comprising a base or ramp element being adjustably positioned on said lengthwise beam by threaded adjusting rods having springs, said base member having a plurality of guide rods with one rod for each of said levers, a spring extending from each guide rod to its respective lever to bias the roller of the lever towards the endless belt of the lower straightening means.

Other advantages and features of the invention will be readily apparent from the following description of the preferred embodiments, the drawings and claims.

DESCRIPTION OF THE PREFERRED EMBODIMENTS

Figure 1:
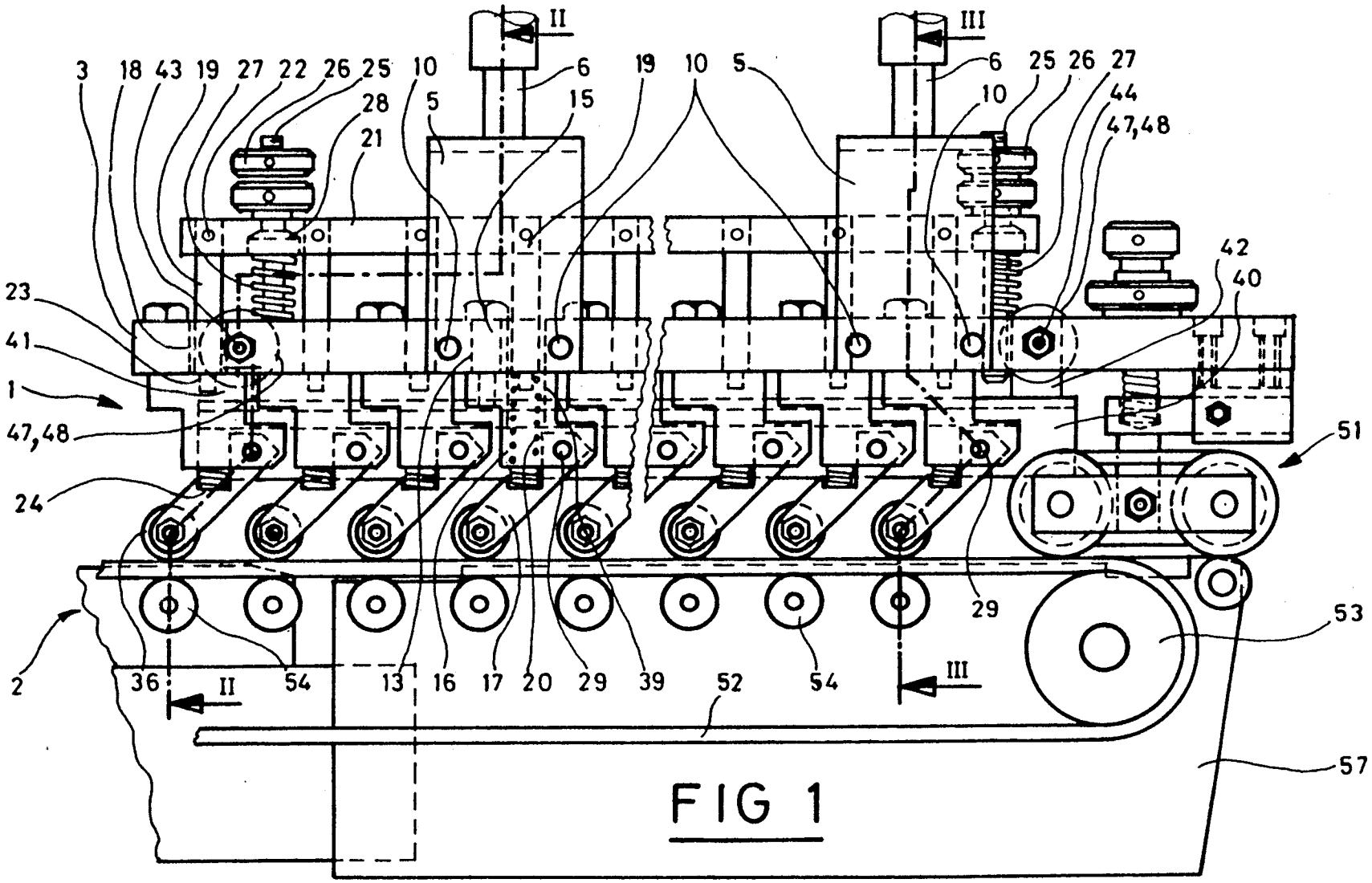
FIG. 1 is a schematic side view of a box blank straightening device according to the present invention.

The principles of the present invention are particularly useful in a device designed for aligning box blanks, illustrated in FIG. 1, including an upper straightening appliance or means, generally indicated at 1, and a lower straightening appliance or means, generally indicated at 2. The upper straightening appliance or means 1 includes a fixed lengthwise beam 3, which is connected to a brace or frame member 4 (see FIG. 2) of a folder-gluer by means of two straps 5. The straps 5 are secured at one of its ends by means of screws 7 (FIG. 3) in a lower part of an adjusting rod 6 held in a support 8, which is fitted against one of the side braces or frame members 4 by means of screws 9. The strap 5 is fitted at its other end against one of the sides of the fixed length beam 3 and is secured thereto by means of screws 10. The adjusting rod 6 is locked in place by means of a block 11, which has considerably less width than one of the supports 8 and allows, when the screws 12 are tightened, to insure a vertical locking of the adjustment rod 6 in the desired position.

Figure 3:
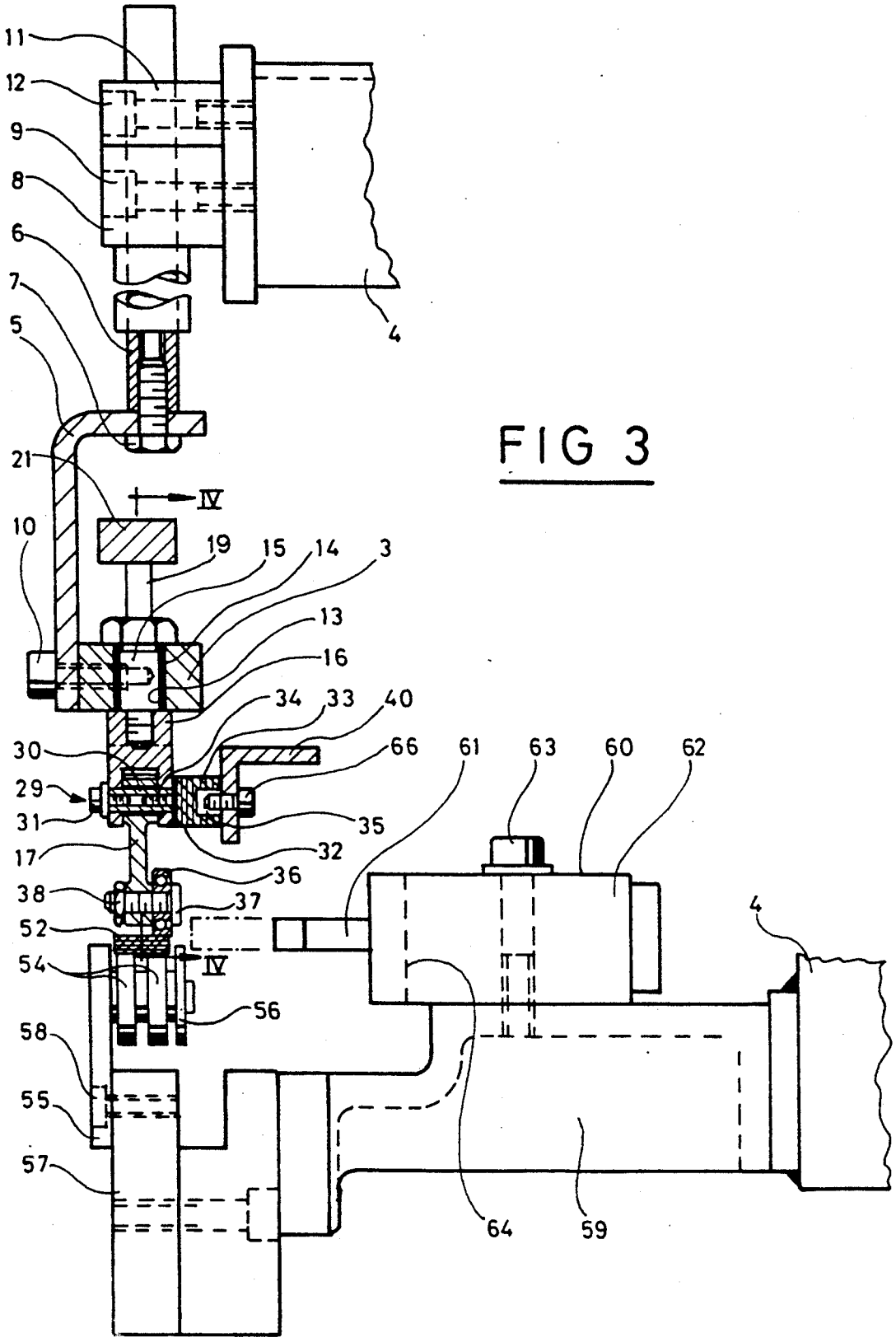
FIG. 3 is a cross sectional view with portions in elevation for purposes of illustration taken along the lines III—III of FIG. 1.
Figure 4:
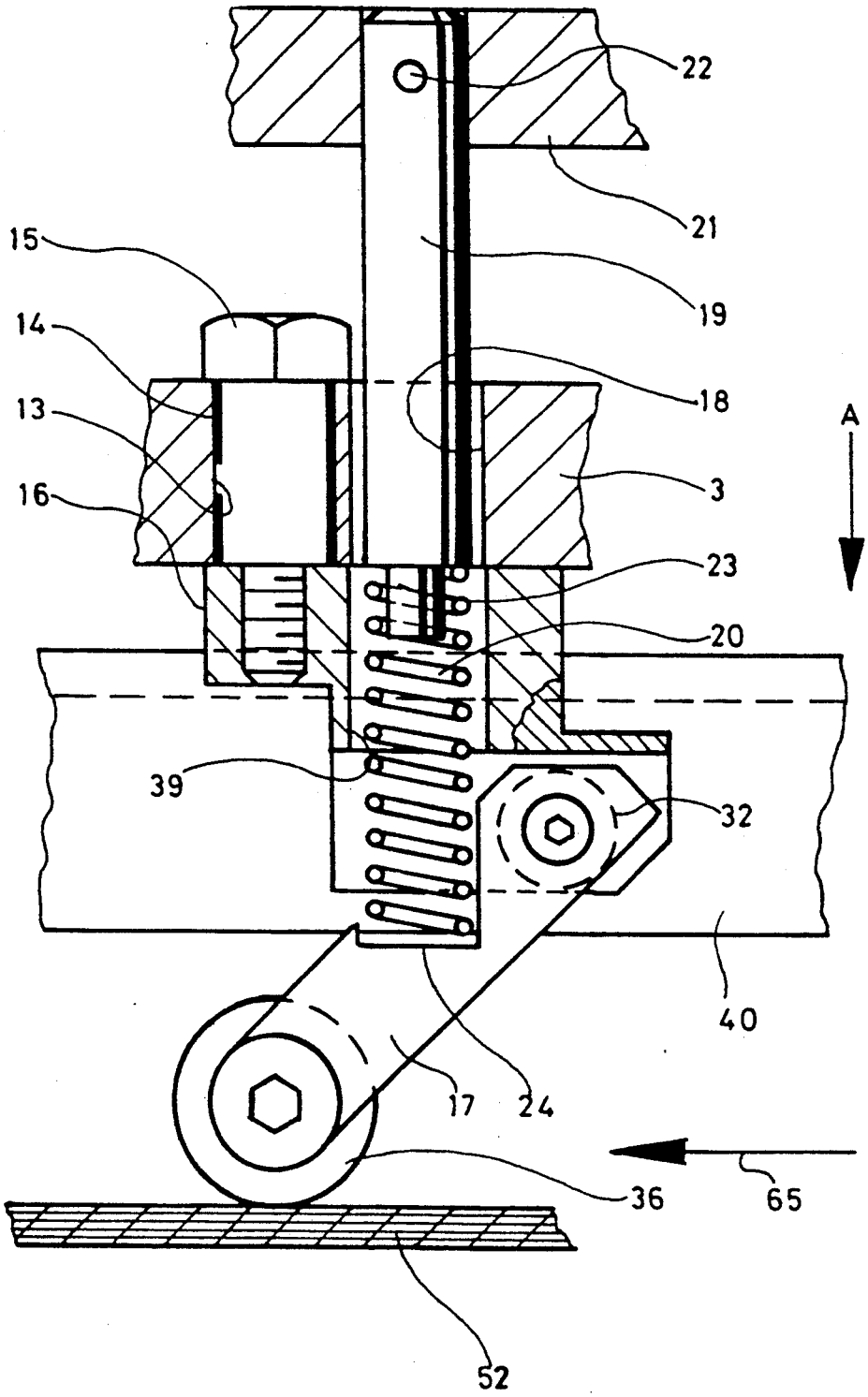
FIG. 4 is a partial, enlarged cross sectional view taken along the lines IV—IV of FIG. 3.

The fixed lengthwise beam 3 has a number of spaced holes 13 (see FIGS. 3 and 4). Self-lubricating bushings 14 are inserted in each of the holes 13 and receive studs 15 which act as pivot points for supporting a support or base 16 of a pivoting lever 17. The lengthwise beam 3 also includes holes 18, through which guide posts 19 for springs 20 are to be inserted. The guiding post or rods 19 are secured at one end to a ramp or base element 21 by means of an elastic split pin 22 (see FIG. 4). At the other end, each guiding rod 19 has a bearing shell or extension 23 for guiding an upper part of the spring 20, whose lower end is supported in an opening or seat 24 milled in the pivoting lever 17.

The ramp or base element 21 is adjustably mounted on the fixed lengthwise beam 3 by means of a threaded adjusting rod 25 (see FIG. 1), which has one end fitted into the beam 3 and the other end is provided with two knurled knobs 26 designed for insuring the setting of the pressure of the upper straightening appliance or means 1. To this aim, it is envisioned to fit a compression spring 27 around the threaded adjustment rod 25 to extend between the beam 3 and the base element 21. This compression spring 27 is guided in a hole 28 which is machined on a lower surface of the base element 21. In this way, a screwing in or out of the first knurled knob 26 will increase or decrease the pressure exerted by the upper straightening appliance 1 on the box blanks. This pressure is formed by the combination of the springs 20 and 27.

The pivoting lever 27 (see FIGS. 2 and 3) is supported by an axle 29 on the support or base 16 in such a way that a pivoting action will occur in a vertical plane around the axle 29 which is a horizontal axis. The axle 29 consists of a threaded bushing 30 held in the support 26 by a screw 31 fitted at one end and by a screw 34 of a flexible appliance 32 screwed into the other end. The flexible appliance 32 preferably consists of a rubber cylinder 33 on which has been fitted the threaded screw or rod 34 and, at the other end, has a threaded ring or nut 35. The lower end of the pivoting lever 17 is provided with a roller 36 which preferably consists of a ball bearing fitted on the lever by means of a screw 37 and a nut 38. In order to improve the adherence or friction between the outer surface of the roller 36 on the box blanks, it is easy to imagine that this roller or outer race is coated with a material, such as rubber.

The support or base 16 is arranged in such a way as to leave a passage or vertical bore 39 for the spring 20. This passage 39 is actually a hole with a sufficiently large diameter to prevent its walls from touching the spring during the pivoting action of the support 16 around the vertical axis of the stud 15.

Figure 2:
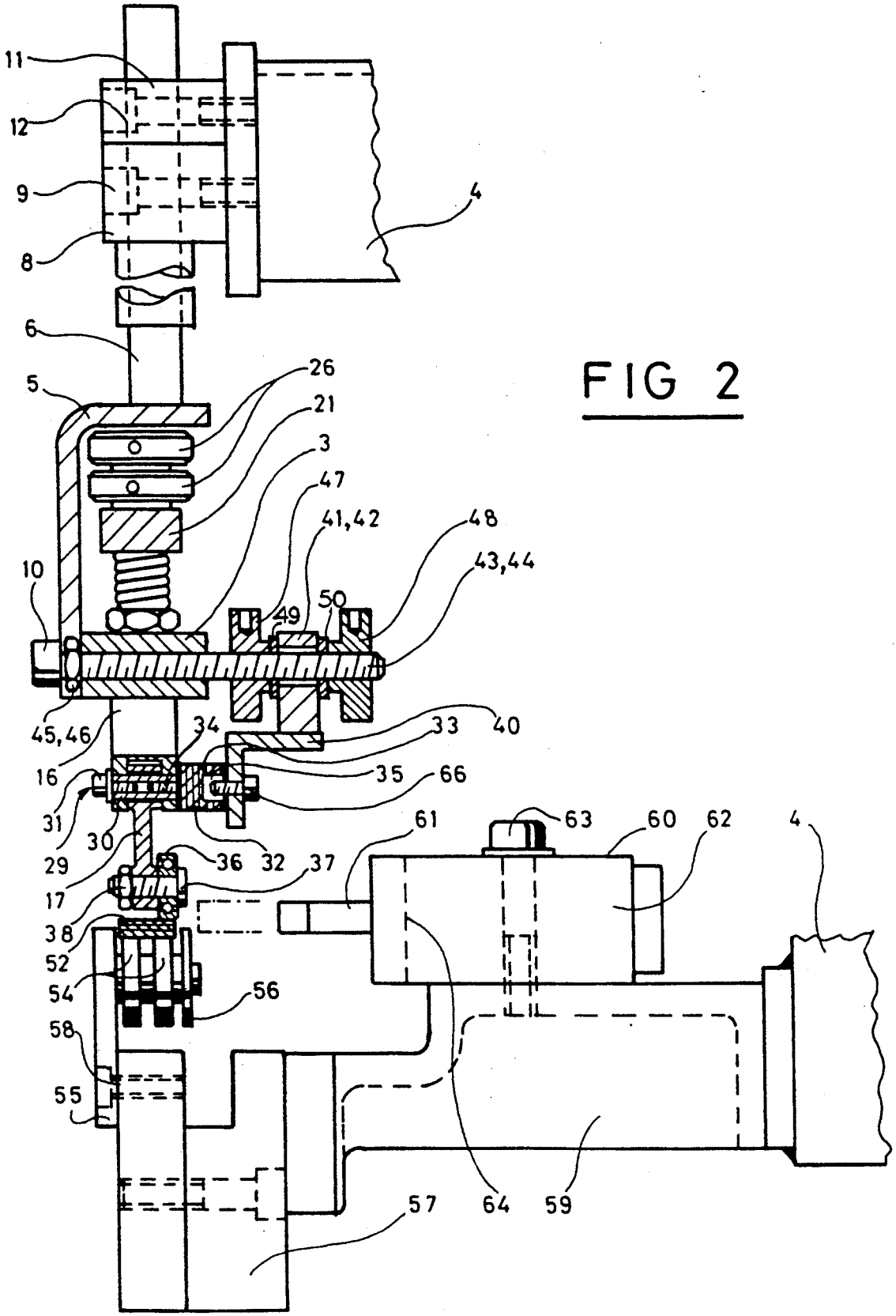
FIG. 2 is a cross sectional view with portions in elevation taken along the lines II—II of FIG. 1.

Every flexible appliance 32 screwed on the end of the threaded bushing 30 is connected to a corner piece or member 41 by means of screws 66 engaged in the threaded nut 35. This corner piece 44 is provided with two projections or flaps 41 and 42, through which threaded rods 43 and 44 are fitted. The threaded rods 43 and 44, as illustrated in FIG. 2, are screwed through the fixed lengthwise beam 3 and secured in their position by means of nuts 45 and 46. The knurled knobs 47 and 48 are fitted on the threaded rod 43 or 44 in such a way as to enable the shifting of the corner piece 40 along a horizontal plane relative to the fixed member or beam 3. Washers 49 and 50 are provided to provide a reliable contact between each of the flaps 41 or 42 and their respective knurled knobs 47 and 48.

As illustrated in FIG. 1, a conveyance device 51 is pivotably mounted on the beam 3 and is adjustable under pressure to form an inlet of the upper and lower straightening appliances 1 and 2, respectively. This device is an accessory and is destined actually for insuring the conveyance of the blank from the infeed device to the straightening appliance.

The lower straightening appliance 2 is arranged in line with the upper straightening appliance 1. The lower straightening appliance or means 2 consists of a driven endless belt 52 traveling around a pulley 53 and being supported by a row of rollers 54, the axles of which are vertically aligned with the axles of the rollers 36 of the upper straightening appliance 51. The rollers 54 support the endless belt 52 and are, preferably, made of a two ball-bearings arranged side-by-side between the two lateral guides 55 and 56 (see FIGS. 2 and 3). One of these two lateral guides 55 or 56 is fitted on a lower lengthwise beam 57. The lower lengthwise beam 57 is mounted by means of an arm 59 to a brace or frame 4 of the folder and gluer.

A lengthwise aligning means 60 includes a lengthwise guiding rail 61 welded on two supports 62 which are arranged in such a way as to allow the shifting of the assembly on a horizontal plane. This lengthwise aligning means 60 can be positioned with screws 63 inserted into slots 64 existing in the support 62. Tightening of the screws 63 enables the fixing of the lengthwise aligning means 60 on the arms 59, each of which is mounted on the frame or brace 4. FIGS. 2 and 3 illustrate in dash-dot lines the stroke which can be effected by the lengthwise aligning means 60.

Figure 5:
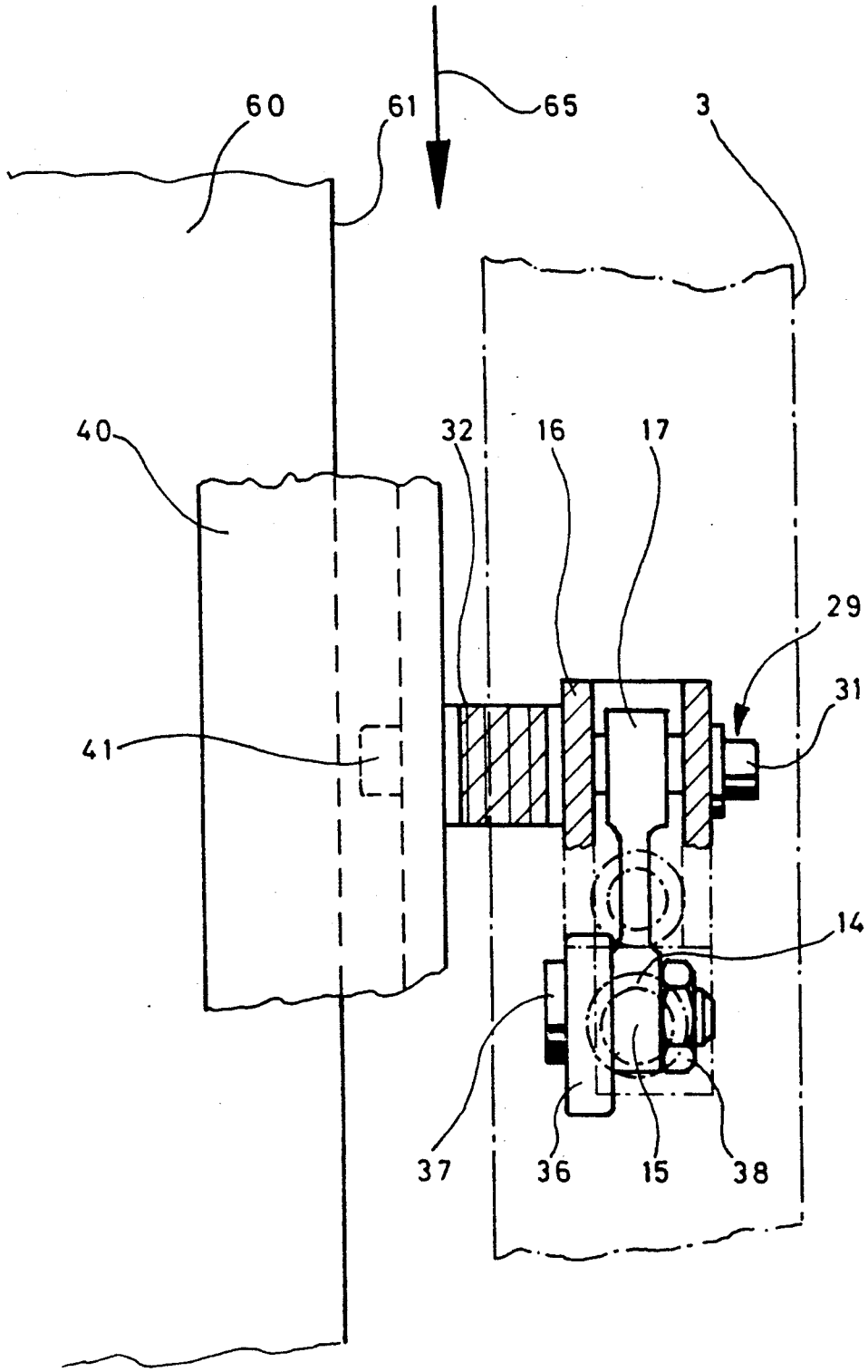
FIG. 5 is a cross sectional view taken in the direction of the arrow A of FIG. 4 illustrating one of the elements of the upper straightening appliance in a neutral position.

As mentioned above, the corner member or piece 40 can be moved in various positions. As illustrated in FIG. 5, it is moved to a neutral position so that the lever 17 and, hence, the roller 36 extend parallel to the lengthwise axis of the machine, such as the folder-gluer. Thus, blanks traveling in a direction shown by the arrow 65 will not undergo any sideways or lateral shifting. Thus, without any dismantling and by simply moving the corner member 40 into this neutral position will transform the device for aligning box blanks into a simple blank conveying device.

Figure 6:
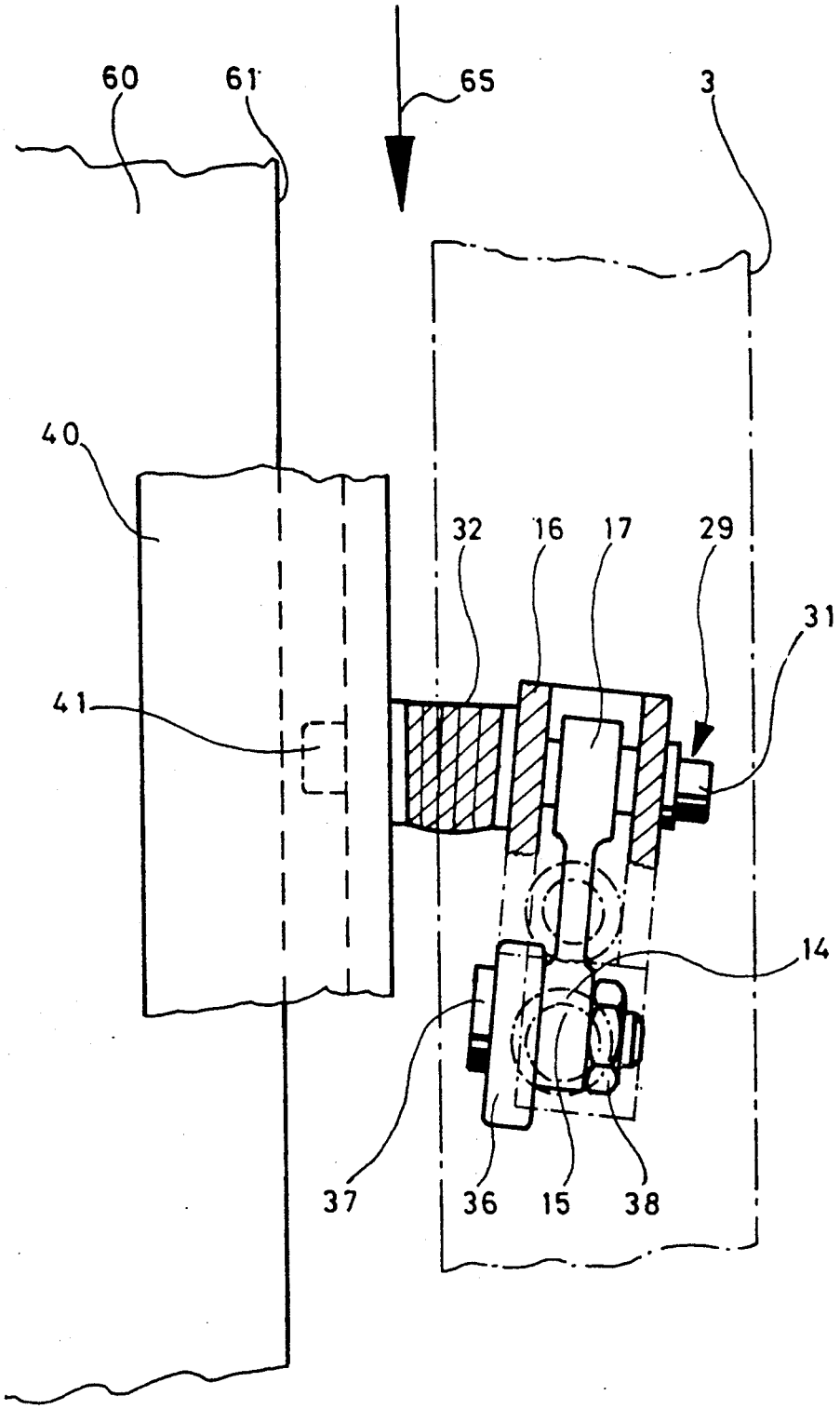
FIG. 6 is a view similar to FIG. 5 illustrating the element of the upper straightening appliance in an operating position.

However, if the corner piece or member is shifted laterally towards the lengthwise beam 3, this lateral movement will be transferred through the flexible appliance or member 32 to each of the pivoting levers 17 to cause it to pivot around the vertical axis formed by the stud 15, as illustrated in FIG. 6. Thus, the pivoting lever will have a slanting position relative to the guiding rail 61 and cause blanks moving in the direction of the arrow 65 to be shifted laterally against the guiding edge of the guiding rail 61 of the lengthwise aligning means 60. The shifting of the corner piece 40 is obtained by the knurled knobs 47 and 48. The amount of shifting depends on the amount of change or turning of the knobs and, in turn, the amount of shifting will determine the angle imparted to the support or base 16. By adjusting the angle of the pivot of the base 16 on the stud 15, the amount of lateral force applied to each of the blanks can be controlled and the amount of pressure of each of the edges of the blanks against the guiding rail 61 will be under control.

It is obvious that with a view of automating the device, it would be easy to have the knurled knobs 47 and 48 substituted by a motor-driven fork acting on the flaps or projections 41 and 42 of the corner piece 40.

On account of the possibility of pivoting the support 16, both in a clockwise and counterclockwise direction or right and left relative to the motion of the box blank, it is conspicuous that, in certain conditions, for example when the blank of lesser width is processed, it will be possible to use an aligning device without the necessity to dismantle it from one side of the folder-gluer in order to have it fitted on the other side with a simple purpose of benefitting from longer blanks for the aligning action.

The device of the present invention, thus, has the advantage of reducing the setup time involved with the folder-gluer when a job is being changed and provides the possibility of being used differently and without any dismantling as either a straightener or as a simple appliance for conveying the box blanks.

Although various minor modifications may be suggested by those versed in the art, it should be understood that I wish to embody within the scope of the patent granted hereon all such modifications as reasonably and properly come within the scope of my contribution to the art.

I claim:

1. In a device for aligning box blanks within a folder-gluer processing the blanks, said device comprising upper straightening means, lower straightening means, said upper and lower straightening means acting jointly with lengthwise aligning means, and said upper straightening means being provided with means for adjusting a pressure of the upper straightening means on the box blanks, the improvements comprising said upper straightening means comprising a lengthwise beam being mounted on a frame of said machine, a plurality of roller assemblies being spaced along said beam, each assembly including a roller mounted for rotation on one end of a lever said lever being mounted on a base for pivotal movement around a horizontally extending axis, and means for pivotably mounting said base on the lengthwise beam for pivoting around a vertical axis, a flexible member being connected to each of said bases and extending to a corner piece, means for shifting said corner piece in a horizontal plane relative o said lengthwise beam, said lower straightening means consisting of a driven endless belt supported by lower rollers, said lower rollers having axles which are aligned to be vertical beneath the axles of the rollers of the upper straightening means, said lengthwise aligning means consisting of a lengthwise guiding rail and means for shifting said rail in a horizontal plane with regard to the upper and lower straightening means, and said means for adjusting the pressure on the upper straightening means comprising a ramp member having spaced guiding rods with one guiding rod for each of said roller assemblies, a spring extending between each guiding rod and its associated lever, and means for adjustably mounting said ramp member on the lengthwise beam including threaded adjusting rods and springs.

2. In a device according to claim 1, wherein the means for pivotable mounting for each of the roller assemblies consists of a stud passing through a bushing received in a bore in the lengthwise beam, said stud being secured to the base of the assembly.

3. In a device according to claim 1, wherein each of the flexible members comprises a rubber cylinder having a threaded rod at one end and a threaded nut at the other end.

4. In a device according to claim 3, wherein said flexible member has said threaded rod secured to an axle of the pivoted lever.

5. In a device according to claim 1, wherein the corner piece has two projecting flaps and said means for horizontally shifting the corner piece in a plane relative to the lengthwise beam includes threaded rods secured to one of said beams and flaps and knobs threaded on said rods for causing the rod to move relative to the other of said beam and flap.

6. In a device according to claim 5, wherein the threaded rods are secured on said lengthwise beam and said knobs shift the flap and the corner piece on said threaded rods.

* * * * *